US008182510B2

(12) United States Patent
Brabant et al.

(10) Patent No.: US 8,182,510 B2
(45) Date of Patent: May 22, 2012

(54) STERLING SILVER AND/OR METAL GEL AND/OR LIQUID CENTERED TEETHER

(76) Inventors: Lisa Ann Brabant, Stony Brook, NY (US); Erika Natalia Kuver-DelDuca, Tuckahoe, NY (US)

( * ) Notice: Subject to any disclaimer, the term of this patent is extended or adjusted under 35 U.S.C. 154(b) by 290 days.

(21) Appl. No.: 12/156,291

(22) Filed: May 30, 2008

(65) Prior Publication Data

US 2009/0299410 A1 Dec. 3, 2009

(51) Int. Cl.
*A61J 17/02* (2006.01)

(52) U.S. Cl. ..... 606/235

(58) Field of Classification Search ..... 606/234–236
See application file for complete search history.

(56) References Cited

U.S. PATENT DOCUMENTS

| | | | | | |
|---|---|---|---|---|---|
| 58,186 | A * | 9/1866 | Bourguard | ..... | 604/93.01 |
| 447,164 | A * | 2/1891 | Simpson | ..... | 446/81 |
| 462,763 | A * | 11/1891 | Grabler | ..... | 606/235 |
| 552,399 | A * | 12/1895 | Smith | ..... | 446/419 |
| 2,514,844 | A * | 7/1950 | Cohen | ..... | 606/235 |
| 2,566,595 | A * | 9/1951 | Cameron | ..... | 606/235 |
| 3,653,386 | A * | 4/1972 | Jacobus | ..... | 606/236 |
| 3,669,117 | A * | 6/1972 | Herbst | ..... | 606/235 |
| 5,766,223 | A * | 6/1998 | Johnson | ..... | 606/235 |
| 2003/0181948 | A1 * | 9/2003 | Dunn et al. | ..... | 606/235 |
| 2004/0215234 | A1 * | 10/2004 | McCardell | ..... | 606/235 |
| 2004/0267319 | A1 * | 12/2004 | Stack | ..... | 606/235 |

* cited by examiner

*Primary Examiner* — Ryan Severson

(57) ABSTRACT

The present invention is a multi-textured infant teether or teething device, where a portion of the teether is comprised of a rounded and curved, hard, smooth, hollow, metal exterior that is comprised of sterling silver, aluminum or any other rust-resistant metal material and a portion of the teether is comprised of a handle that is comprised of either metal covered by rubber or plastic or solely of rubber or plastic to prevent the teether from becoming too cold to hold. Inside the multi-textured teether will be a liquid or gel that has the ability to remain cold for a prolonged time period following refrigeration or freezing. Said liquid or gel center shall be comprised of water, food grade propalyne glycol, any other food grade, freezer-friendly gel or similar non-toxic material. The interior liquid or gel shall be enclosed in a sealed bag, enclosed expandable plastic material or other container capable of being frozen while holding a liquid and/or gel in order to prevent leakage.

4 Claims, 2 Drawing Sheets

STERLING SILVER AND/OR METAL GEL AND/OR LIQUID CENTERED TEETHER

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM, LISTING COMPACT DISC APPENDIX

Not Applicable

BACKGROUND OF THE INVENTION

1. Field of Invention

This invention relates generally to infant care devices and more specifically to infant teethers.

2. Description of Prior Art

Teething is the eruption through the gums of baby teeth. Devices for soothing and quieting infants during the teething process are well known. Teethers, objects or devices for an infant to bite on during teething, in particular, have been commonly used for many years to soothe discomfort resulting from infant teething. Typical teethers consist of a rubber exterior, which may contain a freezable liquid that is refrigerated before use in order to numb an infant's gums and relieve teething pain.

It is an objective of this invention to provide a new and improved multi-textured teether, where a portion of the teether is comprised of a rounded and curved, hard, smooth, hollow, metal exterior with a freezable liquid or gel center that will remain cold for an extended period of time following removal from refrigeration and/or after freezing and a portion of the teether is comprised of a handle that is comprised of either metal covered by rubber or plastic or solely of rubber or plastic to prevent the teether from becoming too cold to hold. There is a need for a multi-textured teether that accommodates an infant's desire for a cold, hard, rounded and curved, smooth surface that, due to these contours and features, is able to reach the otherwise inaccessible areas of an infant's mouth and that will provide some relief from discomfort, hasten the eruption of the teeth from the gums, while providing the infant with a handle that does not become too cold to hold and which will also capture an infant's interest, thereby encouraging the continued use and manipulation of the teether in order to provide a distraction from the general discomfort associated with the teething process.

BRIEF SUMMARY OF THE INVENTION

The present invention is a multi-textured infant teether or teething device, where a portion of the teether is comprised of a rounded and curved, hard, smooth, hollow, metal exterior that is comprised of sterling silver, aluminum or any other rust-resistant metal material and a portion of the teether is comprised of a handle that is comprised of either metal covered by rubber or plastic or solely of rubber or plastic to prevent the teether from becoming too cold to hold. The handle of the multi-textured teether shall have multi-colored designs and patterns.

Inside the multi-textured teether will be a liquid or gel that has the ability to remain cold for a prolonged time period following refrigeration or freezing. Said liquid or gel center shall be comprised of water, food grade propalyne glycol, or any other food grade, freezer-friendly gel or similar non-toxic material. The interior liquid or gel shall be enclosed in a sealed bag, enclosed expandable plastic material or other container capable of being frozen while holding a liquid and/or gel in order to prevent leakage. The gel packet will lie within the hollow metal exterior of the teether. There may be multiple gel packets in any given teether.

The multi-textured teether may also include a rattle, spinning mechanism or other enhancement in any part, or multiple parts, of the device to hold an infant's attention. The multi-textured teether shall be shaped as a ring, a barbell, a decorative design or an animal.

The underlying objective of the design is to create a new and improved multi-textured teether, where a portion of the teether is comprised of a rounded and curved, hard, smooth, hollow, metal exterior and a portion of the teether is comprised of a handle that is comprised of either metal covered by rubber or plastic or solely of rubber or plastic to prevent the teether from becoming too cold to hold. Such a teether will remain cold for an extended period of time following removal from refrigeration and/or after freezing and will soothe an infant's gums, while simultaneously stimulating the infant and holding their attention and continued interest in the teether.

Other objectives, advantages, features and benefits of the present invention will be apparent from the description, taken together with the drawings, and from the claims that follow.

BRIEF DESCRIPTION OF THE SEVERAL VIEWS OF THE DRAWINGS

The details of one or more embodiments of the invention are set forth in the accompanying drawings and the descriptions below, where like numerals indicate like components.

DETAILED DESCRIPTION OF THE INVENTION

Figure 1:
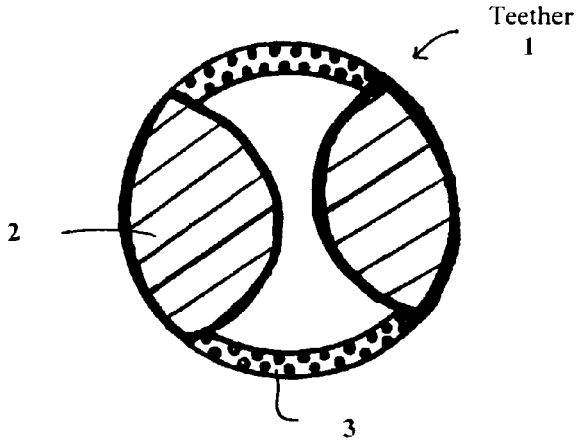
FIG. 1 is a top plan view of a sample multi-textured baby teether showing our new design.
Figure 2:
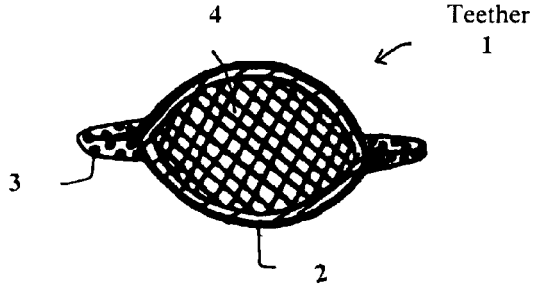
FIG. 2 is an elevational and cross-sectional view of the sample multi-textured baby teether.
Figure 4:
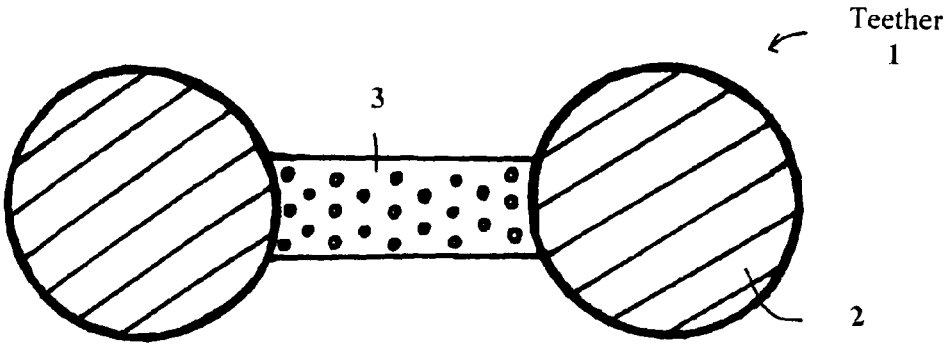
FIG. 4 is a top plan view of a sample multi-textured baby teether showing our new design.
Figure 5:
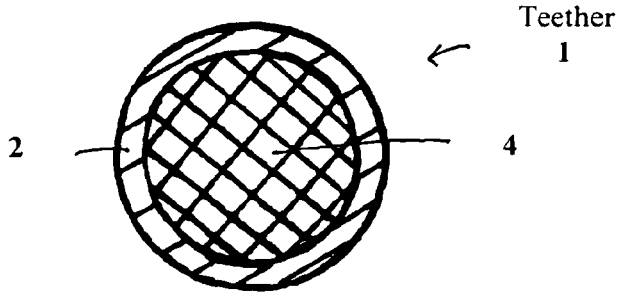
FIG. 5 is an elevational and cross-sectional view of the sample multi-textured baby teether.

Reference is made in detail to some embodiments of the invention, examples of which are illustrated in the accompanying drawings. Referring to the drawings, FIG. 1 and FIG. 4 show a top plan view of a sample multi-textured infant teether 1 that includes a sterling silver, aluminum or other rust-resistant metal exterior 2 with one or more handles composed of rubber 3 for an infant to hold. FIG. 2 and FIG. 5 depict an elevational and cross-sectional view of the sample multi-textured infant teether 1 showing a freezable gel or liquid packet 4 within the metal exterior 2. The metal exterior 2 provides a cold, hard, smooth teething surface that will provide an infant with some relief from discomfort and hasten the eruption of teeth from the gums.

Figure 3:
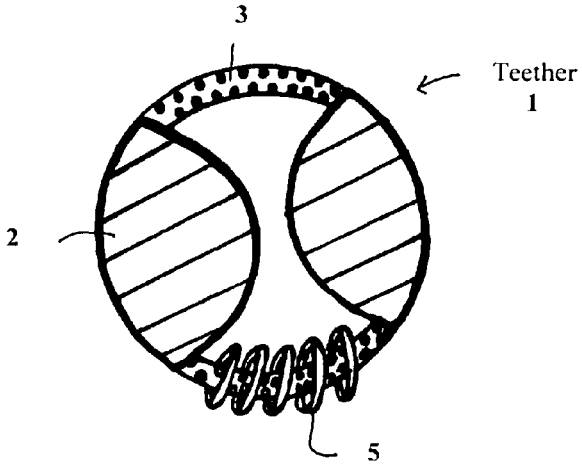
FIG. 3 is a top plan view of our new design with a sample enhancement to the multi-textured baby teether.
Figure 6:
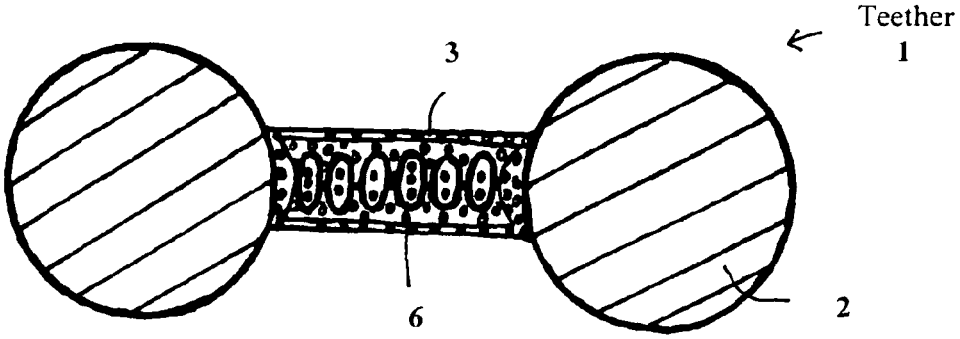
FIG. 6 is a top plan view of our new design with a sample enhancement to the multi-textured baby teether.

As shown in FIG. 3 and FIG. 6, the multi-textured infant teether 1 may also include enhancements secured to the handle 3 in order to hold an infant's interest in the teether and to offer additional textures, materials, surfaces and shapes upon which the infant can teethe and chew. For example, as shown in FIG. 3, plastic rings 5 can be attached to one of the teether's handles 3. FIG. 6 shows a set of plastic beads 6 attached to the handle 3 that can be spun by an infant or that can, additionally, be inserted into the infant's mouth to teethe and chew on. Additionally, the handles 3 of the multi-textured infant teether shall be in a variety of multi-colored designs and patterns.

While the above description contains many specificities, these should not be construed as limitations on the scope of the invention, but rather as an example of the invention. Many other variations are possible.

For example, the exterior of the multi-textured infant teether can be comprised of any metal that is rust-resistant and non-toxic. In addition, the gel or liquid packet contained in the hollow, metal exterior may be any liquid and/or other fluid that is non-toxic. Many such fluids are conventionally available that have the freezing/refrigeration properties needed for this multi-textured teether.

Additionally the size, shape, composition, color and texture of the multi-textured infant teether may well vary and such variations are contemplated by the invention. An integral handle or carrying strap may be added.

A number of embodiments of the invention have been described. Nevertheless, it will be understood that various modifications may be made without departing from the spirit and scope of the invention. Accordingly, other embodiments are within the scope of the following claims.

What is claimed is:

1. A ring-shaped multi-textured teething device, comprising:

two distinct hollow portions comprised of a rounded and curved, hard, smooth, metal exterior, comprised of sterling silver, aluminum or any other rust-resistant metal material;

two distinct handle portions that separate the two distinct hollow portions and the two distinct hollow portions separating the two distinct handle portions, the two distinct hollow portions and the two distinct handle portions defining the ring shape, the two distinct handle portions comprised of either metal covered by rubber or plastic or solely of rubber or plastic to prevent the teether from becoming too cold to hold; and a liquid or gel center disposed within each distinct hollow portion comprised of water, food grade propalyne glycol, or any other food grade, freezer-friendly gel or similar non-toxic material, which shall be enclosed in a sealed bag, enclosed expandable plastic material or other container capable of being frozen while holding a liquid and/or gel in order to prevent leakage.

2. The teething device of claim 1 wherein the teething device comprises multi-colored designs and patterns.

3. The teething device of claim 1 wherein the teething device further comprises a rattle, spinning mechanism or other enhancement.

4. The teething device of claim 1 wherein the teething device is shaped as a decorative design or an animal.

* * * * *